US009340329B2

(12) United States Patent
Melinger et al.

(10) Patent No.: US 9,340,329 B2
(45) Date of Patent: May 17, 2016

(54) PUSH-ON TWIST-OFF BOTTLE CLOSURE

(71) Applicant: Melinger Products LLC, New York, NY (US)

(72) Inventors: Benjamin Melinger, New York, NY (US); Jacob Melinger, New York, NY (US); Alan Paukman, Brooklyn, NY (US)

( * ) Notice: Subject to any disclaimer, the term of this patent is extended or adjusted under 35 U.S.C. 154(b) by 172 days.

(21) Appl. No.: 14/166,478

(22) Filed: Jan. 28, 2014

(65) Prior Publication Data

US 2015/0210445 A1 Jul. 30, 2015

(51) Int. Cl.
*B65D 39/12* (2006.01)

(52) U.S. Cl.
CPC ..... *B65D 39/12* (2013.01)

(58) Field of Classification Search
CPC ..... B65D 45/02; B65D 45/305; B65D 39/12
USPC ..... 220/233–235, 237, 238; 215/364, 318
See application file for complete search history.

(56) References Cited

U.S. PATENT DOCUMENTS 6,769,560 B1 * 8/2004 Lin ..... B65D 39/12 215/361

* cited by examiner

*Primary Examiner* — James N Smalley
(74) *Attorney, Agent, or Firm* — John Laurence

(57) ABSTRACT

A closure system for a drinking bottle or other container is disclosed. The closure system comprises a bottle and a bottle closure. The bottle closure, in turn, comprises among its components a cap interface manipulated directly by the user's hand, a platform that translates vertically in relation to the cap interface, and a flexible annular stopper body directly manipulated by the platform. When the bottle closure is placed on the open bottle neck and the cap interface is pushed downward toward the bottom of the bottle, a lever-based mechanism forces opposite upward movement of the platform. The platform squeezes the stopper body, and at the end of the downward pushing motion, the system is locked in a static position. The squeezed stopper body forms a liquid-tight seal with the bottle, while holding potential energy via elastic deformation. From this sealed position, the cap interface may be radially twisted relative to the bottle, releasing the locked platform and the stopper's potential energy. As the stopper gains its original shape, simultaneously the liquid-tight seal is removed, the cap interface moves upward, and the platform moves downward. The loosened bottle closure may now be separated from the bottle.

14 Claims, 8 Drawing Sheets

FIG. 1
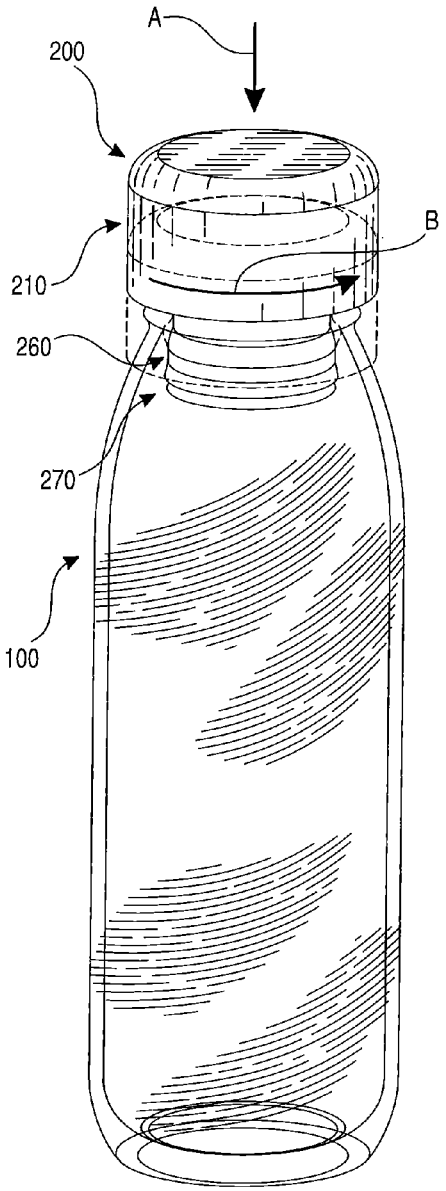
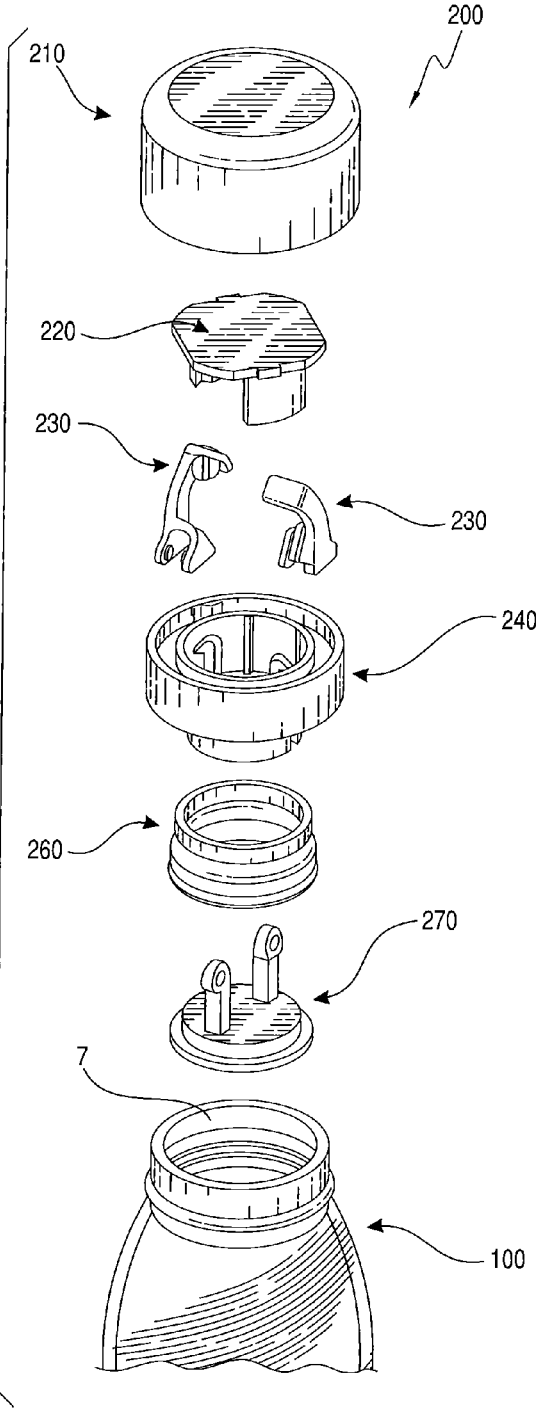
FIG. 2

PUSH-ON TWIST-OFF BOTTLE CLOSURE

BACKGROUND

1. Field of the Invention

This disclosure relates generally to container closures, and, more specifically, to a push-on twist-off closure, which can be quickly secured onto the container or removed from the container.

2. Background

Various containers for storing and transporting liquids have been known and used throughout recorded history. Today, personal containers for transporting liquids are a normal part of our lives. Consumers regularly purchase beverages in single serving containers, which allow them to conveniently carry their beverage and dispose the container after use. Many individuals also own reusable bottles, which help avoid the costs of single serving beverage products, reduce impacts on the environment, and provide a convenient mode for ensuring those individuals receive ample daily hydration.

Reusable bottles are typically manufactured in plastic, metal, or glass. These containers often include a narrowing neck with a fluid access opening. A number of closures types have been used to secure this opening and prevent spillage or leakage, including lids, corks, snap-ons, and screw caps. However, many of these closure mechanisms do not provide the characteristics that modern consumers desire, such as speed of use, ease of use, and assurance that liquids are securely sealed inside the container. For this reason, consumers are continually seeking improved closure mechanisms for sealing containers.

The most common closures for reusable bottles are screw-on plastic or metal caps. Typically, these caps include threads on their inside diameter with counterpart threads on a bottle neck's outside diameter. The cap secures onto the bottle via a screwing motion, which engages the threads and pulls the cap downward onto the bottle. To seal liquid from escaping, the caps typically include a sealing material, which compresses between the bottle lip and the cap when the threads are completely engaged. This solution provides the consumer ease of use and assurance that their liquids are securely sealed. However, consumers would desire a closure mechanism that can be more quickly engaged and disengaged relative to the container.

One bottle closure system that takes into account speed of use includes male circular nubs evenly spaced around the outer diameter of the bottle neck. These nubs fit within short helical tracks formed within the inner diameter of the closure. The user pushes the cap down while completing perhaps a quarter turn to secure and seal the bottle. A fault with this system is that it may be considered overly easy to disengage and may not provide peace of mind that the liquids will remain secure inside the container during transport.

Swing-top solutions consist of a stopper made from cork, rubber, or other sealing materials attached to a latch system. When the latch is engaged, the stopper is secure and the bottle is sealed. When the latch is disengaged, the stopper swings away from the bottle neck and the user gains access to the contained liquid. While this system may provide quicker access to the bottle's contents than a screw-on solution, consumers would desire an even speedier solution. In addition, many consumers would not consider this mechanism easy to use. And further, the latch system must remain permanently affixed to the bottle, so the swinging feature is often an annoyance during typical pouring and drinking operations.

Button- or toggle-activated systems typically include more complex mechanics then the above described systems. These closures can often be quickly engaged to secure liquids in bottles and containers. In one button- or toggle-activated embodiment, the closure defaults to its locked configuration at all times except when the button or toggle is engaged. In order to seal the container, the user must perform two actions at one time, pushing the closure onto the container while concurrently pressing the button or toggle. When the closure is near its sealed position, the user releases the button or toggle, which attaches the closure to the container and forms a seal which liquid cannot escape. Although this mechanism can be quickly engaged and disengaged, a drawback of this system is that the user is required to perform two actions concurrently—placement of the closure on the bottle neck and active engagement of the button or toggle. These actions may be awkward for the user. Further, if the user performs the actions improperly, he risks releasing the button or toggle prematurely, which may result in various semi-secure interfaces between the closure and container.

BRIEF SUMMARY

In one aspect of this disclosure, a closure system for a drinking bottle or other container is disclosed. The closure system comprises a bottle and a bottle closure. The bottle closure, in turn, comprises among its components a cap interface manipulated directly by the user's hand, a platform that translates vertically relative to the cap interface, and a flexible annular stopper body directly manipulated by the platform. When the bottle closure is placed on the open bottle neck and the cap interface is pushed downward toward the bottom of the bottle, a lever-based mechanism forces opposite upward movement of the platform. The platform squeezes the stopper body, and at the end of the downward pushing motion, the system is locked in a static position. The squeezed stopper body forms a liquid-tight seal with the bottle, while holding potential energy via elastic deformation. From this sealed position, the cap interface may be radially twisted relative to the bottle, releasing the locked platform and the stopper's potential energy. As the stopper gains its original shape, simultaneously the liquid-tight seal is removed, the cap interface moves upward, and the platform moves downward. The loosened bottle closure may now be separated from the bottle.

Among the many advantages of the preferred bottle closure disclosed herein are that the preferred bottle closure:

- contains a locking mechanism that is activated by a pushing or smacking motion;
- contains an unlocking mechanism that is activated by a short (less than 360-degrees) turning motion;
- is secured to a bottle and locked more quickly than other closures;
- is unlocked and released from the bottle more quickly than other closures;
- allows the bottle neck to have a relatively high dimensional tolerance, allowing the closure to work well with glass containers, which are generally manufactured with less precision than plastic containers;
- provides a tactile feeling or audible noise at the end of the turning motion indicating that the system has been unlocked; and
- does not require moving parts to be permanently affixed to the bottle, as in some latch jar closures.

The foregoing has outlined rather generally the features and technical advantages of one or more embodiments of this disclosure in order that the following detailed description may be better understood. Additional features and advantages of this disclosure will be described hereinafter, which may form the subject of the claims of this application.

BRIEF DESCRIPTION OF THE DRAWINGS

This disclosure is further described in the detailed description that follows, with reference to the drawings, in which:

FIG. 1 shows a perspective view of the push-on twist-off bottle closure of the present invention in sealed and unsealed positions on a bottle top;

FIG. 2 is an exploded view of the push-on twist-off bottle closure of the present invention;

DETAILED DESCRIPTION

Figure 3A:
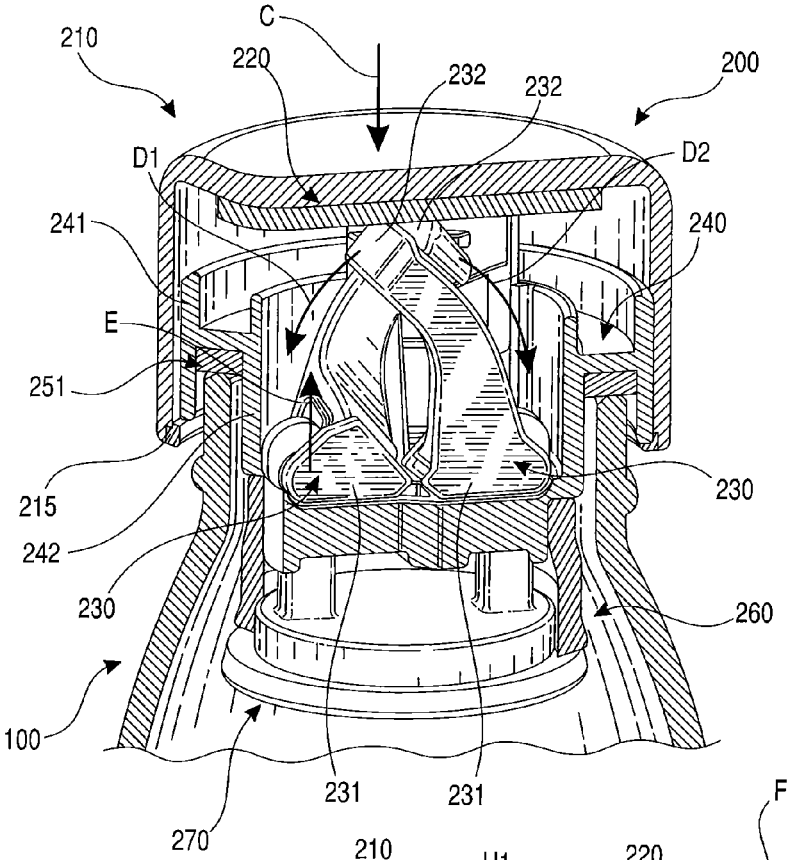
FIG. 3A is a cross section view of the push-on twist-off bottle closure of the present invention is an unsealed position on a bottle top.

A preferred bottle closure allows a user to easily and quickly seal a bottle, and alternatively release the seal and remove contents from the bottle. The bottle closure has a shape and size that corresponds to an open bottle neck. The open bottle neck may be various sizes, such as the neck of a wine bottle or the neck of a canning jar. To seal in the contents of the bottle, a user loosely seats the closure on the bottle neck and pushes down on a cap interface until the bottle closure locks in place. Pushing down on the cap interface causes a flexible seal inside the closure to be squeezed vertically and expand radially forcing contact between the flexible seal and the bottle wall. The contact between the flexible seal and the bottle wall helps to preserve liquids, such as beverages, stored in the bottle. To remove the liquid stored in the bottle, the user turns the cap interface radially, causing the flexible seal to return to its original non-compressed form, and removing contact between the flexible seal and the bottle wall. The user is now able to easily lift the closure from the bottle to access the contents of the bottle.

FIG. 1 shows a perspective view of the push-on twist-off bottle closure of the present invention in sealed and unsealed positions on a bottle top. A sealable bottle closure 200 is removably attached to a bottle 100, and can be transitioned between a sealed and unsealed position. After loosely seating the bottle closure 200 on the bottle 100, the user pushes down in shown direction A on a cap interface 210 to seal the bottle closure 200 onto the bottle 100. Pushing down in this direction A compresses the height of the bottle closure 200, forcing a cylindrical flexible main seal 260 within the bottle closure 200 to bulge outward along its entire circumference to form a liquid-tight seal between the main seal 260 and the inner wall of the bottle 100. At the end of the motion in shown direction A, a lock engages inside the cap so that the cap interface 210 remains in its pushed-down position, and the main seal 260 maintains its liquid-tight seal with the bottle 100. To unlock the bottle closure 200, the user twists the cap interface 210 in shown direction B through approximately a 50-degree turn. This twist releases the lock which in turn causes the bottle closure 200 to expand in height, the main seal 260 to regain its non-bulged cylindrical form, and the bottle closure 200 to lose its liquid-tight seal with the bottle 100. The user may now remove the bottle closure 200 from the bottle 100 and access the contents within the bottle 100.

FIG. 2 is an exploded view of the push-on twist-off bottle closure of the present invention. As shown in FIG. 2, the bottle closure is comprised of the cap interface 210, a cam component 220, a pair of levers 230, a central housing 240, a main seal 260, and a compressing platform 270. The components of the bottle closure 200 are dimensioned so as to fit an open-top neck 7 of the bottle 100.

FIG. 3A is a cross section view of the push-on twist-off bottle closure of the present invention in an unsealed position on a bottle top. The bottle closure 200 is loosely seated in its unlocked configuration on the neck of the bottle 100. An outer housing wall 241 of the central housing 240 is slightly larger in diameter than the neck of the bottle 100, and an inner housing wall 242 is slightly smaller in diameter than the neck of the bottle 100. These concentric walls surround, but do not come into contact with, the neck of the bottle 100. The size of the central housing 240 is therefore primarily determined by the diameter of the neck of the bottle 100. The central housing 240 rests on the neck of the bottle 100 via a washer seal 251, which is anchored between the inner and outer housing walls of the central housing 240, and may be formed using an elastomer material. To remove the bottle closure 200 from the bottle 100, the user lifts the cap interface 210 upward in a direction opposite that of shown direction C. A small inward protruding retaining ring 215 permanently attached to the cap interface 210 engages the bottom of the outer wall 241 of the central housing 240, and the entire assembly is separated from the bottle 100.

To seal the bottle closure 200 onto the bottle 100, after seating the bottle closure 200 on the neck of the bottle 100, the cap interface 210 is pushed downward in shown direction C, carrying the cam component 220, which is sized to fit within the central housing 240, in a similar downward motion. The lever heads 232 of the pair of levers 230, also sized to fit within the central housing 240, are forced to rotate in shown directions D1 and D2, respectively. The lever feet 231 of the levers 230 push against the floor of the central housing 240 and pull the compressing platform 270, sized to fit within the neck of the bottle 100, upward in the shown direction E.

The main seal 260 is also sized to fit within the neck of the bottle 100. The main seal 260 is anchored to both the central housing 240 and the compressing platform 270, and becomes squeezed between these two components. As the compressing platform 270 lifts upward in shown direction E, the main seal 260 shortens and bulges outward, contacting the wall of the bottle 100, preferably forming a liquid-tight seal that does not allow any contents out of the bottle 100. Potential energy is stored in the bulged main seal 260 which is locked in this bulged form by interacting features of the cam component 220 and the central housing 240.

Figure 3B:
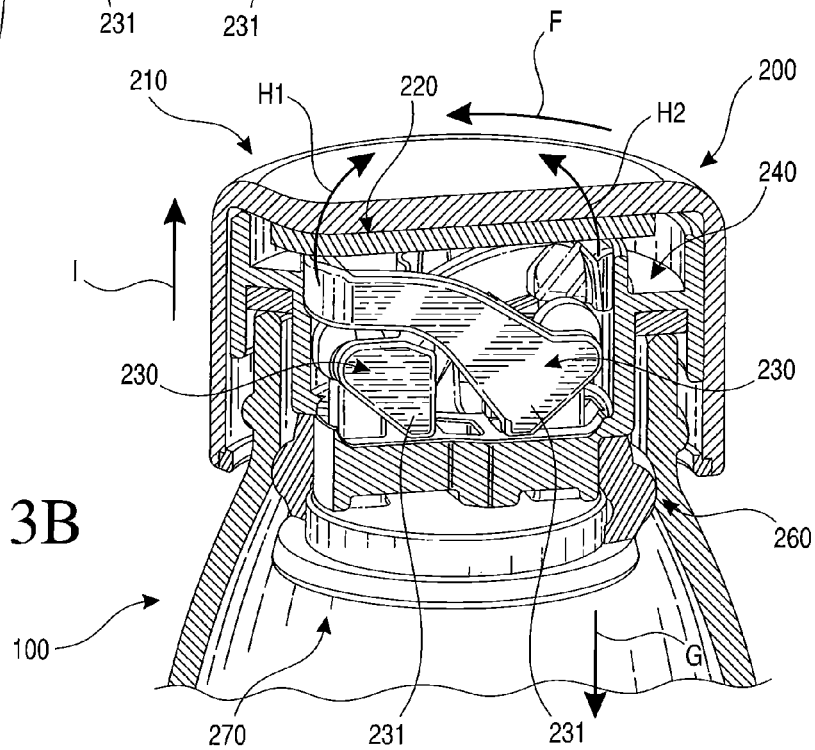
FIG. 3B is a cross sectional view of the push-on twist-off bottle closure of the present invention in a sealed position on a bottle top.

FIG. 3B is a cross sectional view of the push-on twist-off bottle closure of the present invention in a sealed position on a bottle top. To unseal the bottle closure 200, the user twists the cap interface 210 approximately 50 degrees counter-clockwise in the shown direction F. This twist frees the cam component 220, and the cap interface 210 to which it is attached, to move upward relative to the central housing 240. After the twist, the spring-like potential energy stored in the main seal 260 begins to release as it regains its non-bulged cylindrical form. The expanding main seal 260 forces the compressing platform 270 downward in the shown direction G. The compressing platform 270 in turn pulls downward on the lever feet 231. The interaction of the lever feet 231 against the floor of the central housing 240 supplies rotational motion to the lever heads 232 in shown directions H1 and H2. The lever heads 232 push both the cam component 220, and the cap interface 210 to which it is attached, vertically upward in shown direction I. Now the bottle closure 200 is back in its unsealed configuration, as seen in FIG. 3A.

Figure 4:
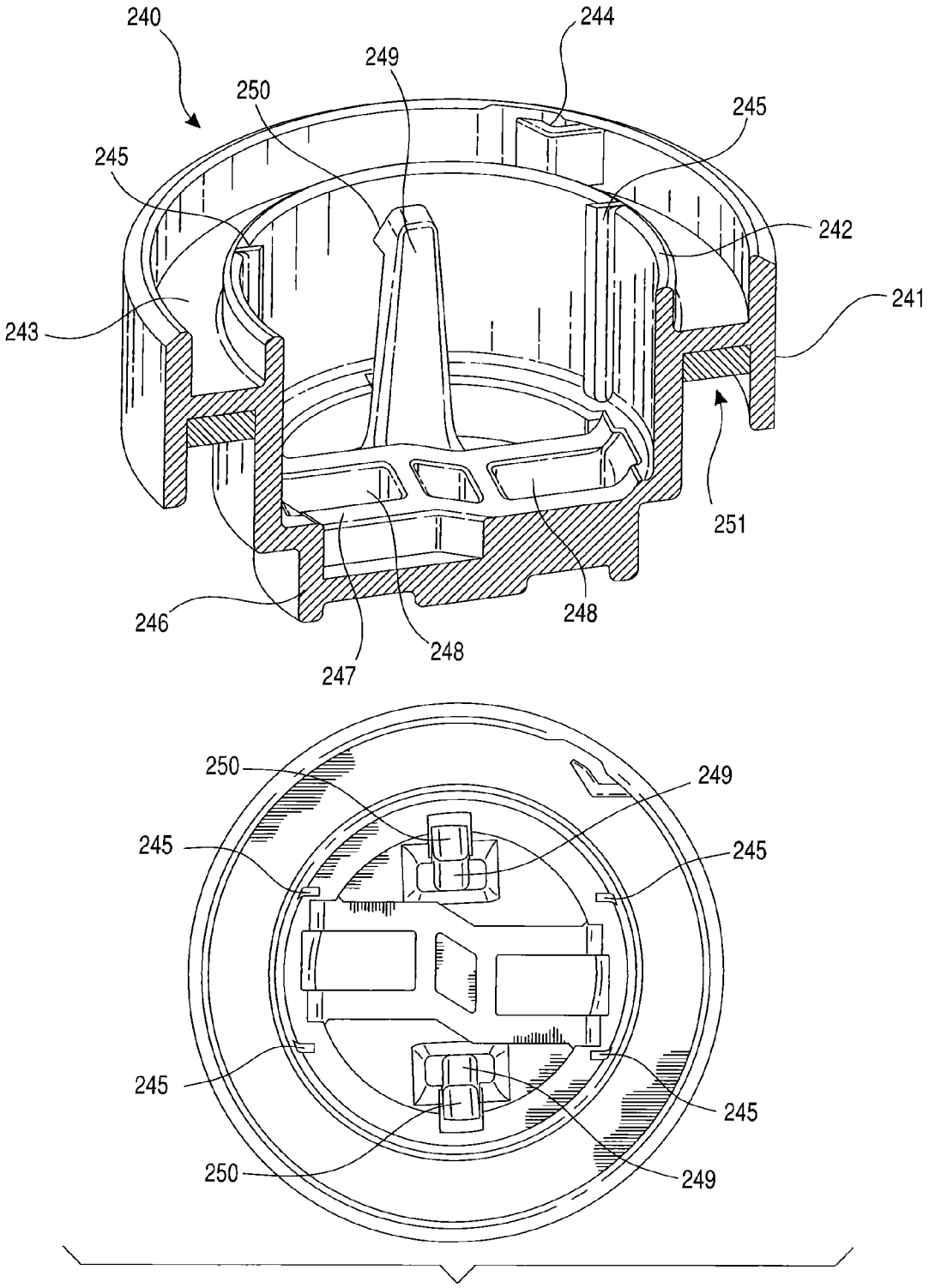
FIG. 4 is a cross sectional view of a central housing component of the push-on twist-off bottle closure of the present invention.

FIG. 4 is a cross sectional view of a central housing component of the push-on twist-off bottle closure of the present invention. The central housing 240 is primarily cup-shaped and is comprised of an outer housing wall 241, an inner housing wall 242, a washer seal seat 243, a motion interrupting gate 244, cam barriers 245, a housing floor 246, lever tracks 247, rectangular slots 248, manipulating posts 249, and hammer-head protrusions 250. A washer seal 251 is permanently attached to the central housing 240.

The cylindrical outer housing wall 241 is concentric to, and has a slightly larger diameter than, the neck of the bottle 100. The cylindrical inner housing wall 242 is concentric to, and has a slightly smaller diameter than, the neck of the bottle 100. Together these housing walls 241 and 242 force proper placement of the bottle closure 200 on the neck of the bottle 100.

The outer housing wall 241 is also concentric to, and has a slightly smaller diameter than, the cap interface 210. During operation of the bottle closure 200, the cap interface 210 at times slides rotationally relative to its neighboring outer housing wall 241, and at times slides vertically relative to the outer housing wall 241.

Two pairs of cam barriers 245 protrude slightly inward from the inner housing wall 242, running the complete vertical length of the inner housing wall 242. The cam component 220, as shown in FIG. 2, slides rotationally relative to the slightly larger diameter inner housing wall 242. This rotational motion is limited by the cam barriers 245, so that the cam component 220 is restricted to rotate within each of the cam barrier pairs 245.

A washer seal seat 243 preferably extends orthogonally between the outer housing wall 241 and the inner housing wall 242, closing the space between the two walls. A washer seal 251, whose outer diameter approximates that of the outer housing wall 241 and whose inner diameter approximates that of the concentric inner housing wall 242, may be made of an elastomer material and sit on the underside of the washer seal seat 243. The washer seal 251 is kept in place by slight radial compression between the inner housing wall 242 and the outer housing wall 241. The washer seal 251 provides a cushioning surface between the central housing 240 and the top surface of the neck of the bottle 100. The washer seal 251 prevents the rigid material of the central housing 240 from wearing against the neck of the bottle 100, and also provides friction so that the central housing 240 remains static against the bottle 100 during the rotational actions of the unsealing operation of the bottle closure 200.

Figure 7:
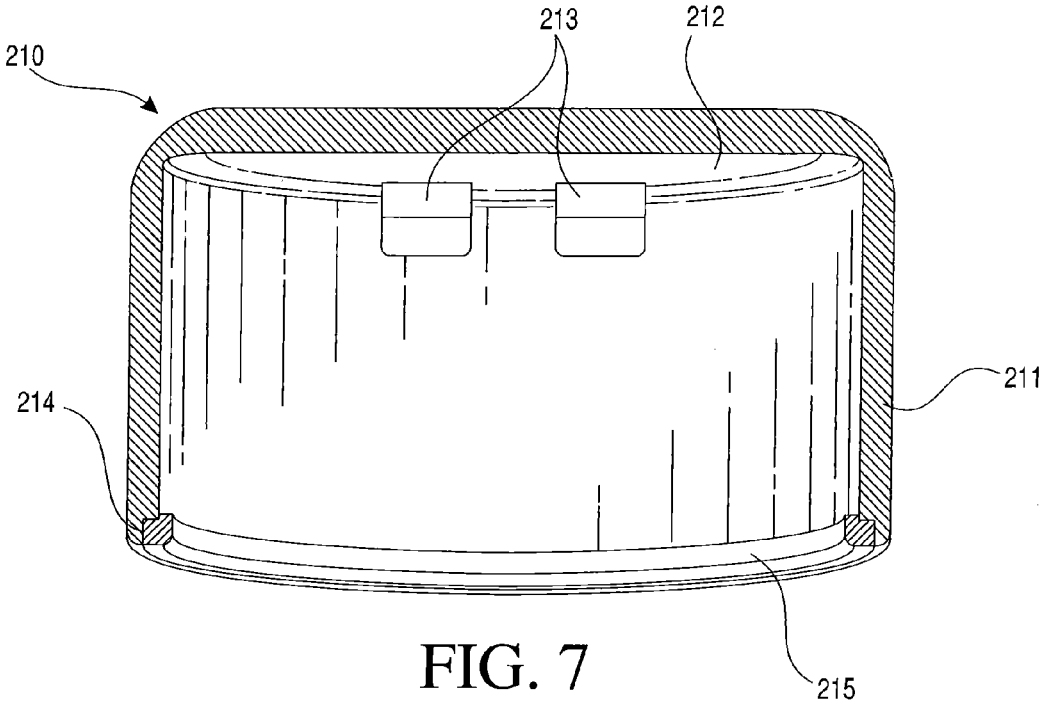
FIG. 7 is a cross sectional view of a cap interface of the push-on twist-off bottle closure of the present invention.

The upper surface of the washer seal seat 243 may be recessed below the upper ends of the outer housing wall 241 and the inner housing wall 242, so that low hanging features of the cap interface 210, as will be described in FIG. 7, are allowed relatively free radial motion between the outer housing wall 241 and the inner housing wall 242. Jutting inward from the outer housing wall 241 is a motion interrupting gate 244. The motion interrupting gate 244 angles inward from the inner diameter of the outer housing wall 241 and is positioned so that an aspect of the low hanging features of the cap interface 210, as will be described in FIG. 7, encounter the motion interrupting gate 244, creating a "click" sound or feeling during the unsealing operation.

Extending downward from the inner housing wall 242 is a housing floor 246 whose outer diameter is smaller than the diameter of the inner housing wall 242. The upper end of the main seal 260, as show in FIG. 2, fits snuggly around the housing floor 246, and stays anchored to the housing floor 246 preferably by a tight fit around the housing floor 246. Alternatively, the main seal 260 could be glued to the housing floor 246 for extra support, or could be anchored to the housing floor 246 by any other viable means of attachment. The housing floor 246 contains two radially symmetric rectangular slots 248. Posts on the compressing platform 270, as shown in FIG. 2, fit through these rectangular slots 248, which allows the compressing platform 270 to move upward and downward relative to the central housing 240. Rising a short distance from the upper surface of the housing floor 246, bounding the rectangular slots 248, are thin-walled lever tracks 247. These lever tracks 247 provide a platform against which the lever feet 231 of the levers 230, as shown in FIGS. 3A and 3B, may slide.

Also rising from the housing floor 246 are two radially symmetric cam component manipulating posts 249. At the upper end of these manipulating posts 249, hammer-head protrusions 250 extend outward toward, and perpendicular to, the concentric housing walls 82. These hammer-head protrusions 250 are dimensioned so that they may easily engage and slide against grooved pathways carved in the cam component 220. The hammer-head protrusions 250 act as hooks that lock the cam component 220 vertically in place at the end of the locking operation. During the unlocking operation, the hammer-head protrusions 250 act as static pin-like features that ride pathways in the cam component 220, forcing the cam component 220 to exhibit precise motions.

Figure 5A:
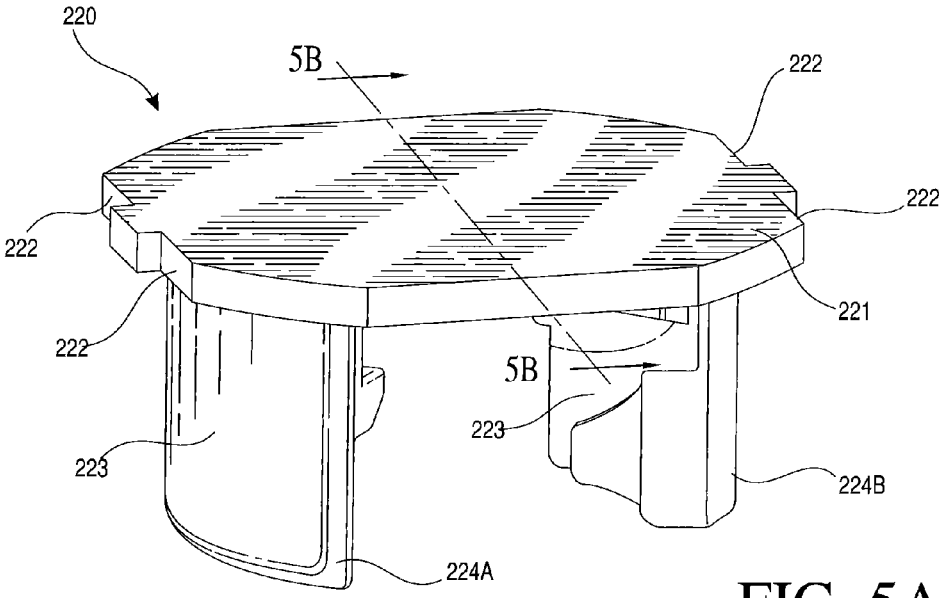
FIG. 5A is a perspective view of a cam component of the push-on twist-off bottle closure of the present invention.

FIG. 5A is a perspective view of a cam component of the push-on twist-off bottle closure of the present invention. As shown, the cam component 220 is comprised of an upper retaining plate 221, retaining grooves 222, cam walls 223, left cam wall edges 224A, and right cam wall edges 224B.

The upper retaining plate 221 is a thin flat surface that fits inside of, and has a static connection to, the cap interface 210. In this embodiment of the invention, the cam component 220 is retained by the cap interface 210 by hook features that snap around the retaining grooves 222 of the cam component 220. Because these parts are bound together statically, any motion experienced by the cap interface 210 is also experienced by the cam component 220, and vice versa.

The cam walls 223 protrude downward from the upper retaining plate 221 and have a slightly smaller diameter than the inner housing wall 242 of the central housing 240. The cam walls 223 do not form a complete cylindrical wall, but may instead each appear as sections of a cylindrical wall, bound by the cam wall edges 224A and 224B. The cam walls 223 slide rotationally and vertically adjacent to the inner housing wall 242 of the central housing 240, and this sliding motion is confined between the cam barriers 245 protruding from the inner housing wall 242.

Figure 5B:
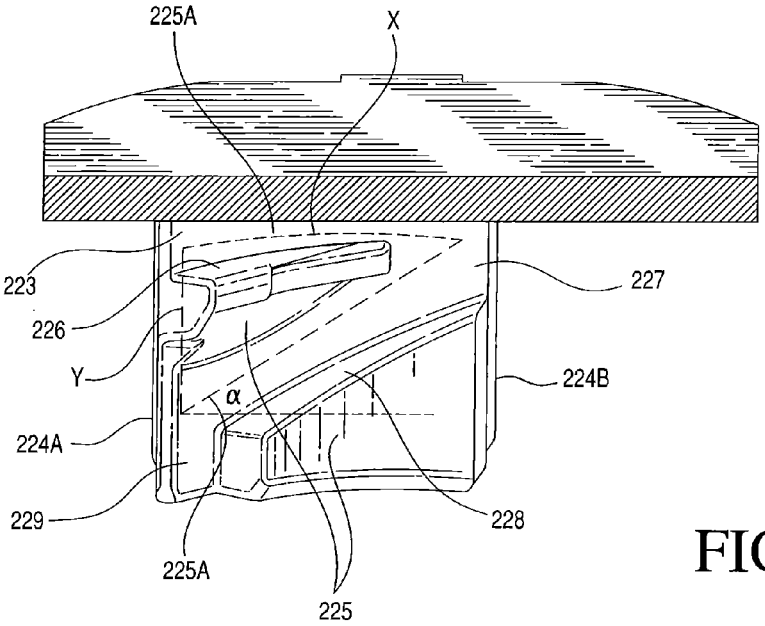
FIG. 5B is a cross sectional view of a cam component of the push-on twist-off bottle closure of the present invention.

FIG. 5B is a cross sectional view of a cam component of the push-on twist-off bottle closure of the present invention. As shown, the cam walls 223 each include the left cam wall edge 224A, the right cam wall edge 224B, cam groove structures 225, a locking ridge 226, a ridge gap 227, a cam ramp 228, and a ramp gap 229.

The cam groove structures 225 protrude inward from the cam walls 223. The cam groove structures 225 include a locking ridge 226 slightly below the upper retaining plate 221. The locking ridge 226 is a primarily horizontal surface extending inward from the cam wall 223, starting at the left cam wall edge 224A running the majority of the distance to the right cam wall edge 224B. The locking ridge 226 provides a surface to which the hammer-head protrusion 250 of the central housing 240 hooks onto at the end of the locking operation.

The lack of a ridge protrusion near the right cam wall edge 224B forms a ridge gap 227. Starting directly below the ridge gap 227, a cam ramp 228 juts inward from the cam wall 223. The cam ramp 228 starts at the right cam wall edge 224B and angles downward toward the left cam wall edge 224A. The cam ramp 228 may not run along the entire cam wall 223 and may end before the left cam wall edge 224A. The lack of a ramp protrusion near the left cam wall edge 224A forms a ramp gap 229. When viewed together, locking ridge 226, ridge gap 227, cam ramp 228, and ramp gap 229 form an approximately right-angled triangular-shaped pathway 225A. The hammer-head protrusion 250 tracks within this pathway 225A during the locking and unlocking operations of the bottle closure 200 (though it must be made clear that, in this primary embodiment, the pathway 225A itself travels around the hammer-head protrusion 250, while the hammer-head protrusion 250 remains in a static position).

As previously discussed, a wide array of bottle neck circumferences (from those of wine bottles to canning jars) may be accommodated by this bottle closure 200 by altering the size of the levers, the mechanical advantage of the levers, the number of levers (with single lever configurations possible), the number and size of the manipulating posts, the number of cam barriers, the diameter of the compressing platform, the diameter of the main seal, the height of the main seal, and the height of the pivoting posts of the compressing platform.

In this preferred embodiment, the angle of the cam ramp (Angle $\alpha$ shown in FIG. 5B) must be between 5 and 85 degrees. If the degrees of turning during the unlocking operation (indicated by Curve X in FIG. 5B) is fixed, then a greater angle of the cam ramp Angle $\alpha$ will require a greater pushing distance (Distance Y shown in FIG. 5B) during the locking operation. A greater pushing distance requires a taller cam component 220, a taller inner housing wall 242, a taller cap interface 210, and taller levers 230. For configurations with taller levers 230, all components that lie in the paths of the levers 230 must be adjusted to avoid component interference. In addition, to maintain the vertical distance traveled by the compressing platform 270 during the locking operation, the shape of the lever feet 231 must be adjusted in order to reduce the mechanical advantage delivered by the levers 230. This reduction to the mechanical advantage consequentially reduces the pushing force required by the user during the locking operation.

If the degrees of turning during the unlocking operation is still fixed, but a smaller angle of the cam ramp is implemented, then a smaller pushing distance will be required. A smaller pushing distance requires a shorter cam component 220, a shorter inner housing wall 242, a shorter cap interface 210, and shorter levers 232. In addition, to maintain the vertical distance traveled by the compressing platform 270, the shape of the lever feet 231 must be adjusted in order to increase the mechanical advantage delivered by the levers 230. This increase to the mechanical advantage consequentially increases the force required by the user during the locking operation. Due to this required increase in force, extremely small pushing distances may be avoided in order avoid straining the human user.

As opposed to the above scenarios, if the pushing distance required during the locking operation is fixed, then the greater the angle of the cam ramp Angle $\alpha$, the smaller the degrees of turning during the unlocking operation. Accordingly, the smaller the angle of the cam ramp Angle $\alpha$, the greater the degrees of turning during the unlocking operation. When the required degrees of turning is increased, the distance between the left cam wall edge 224A and the right cam wall edge 224B must be increased. The distance between the members of the cam barrier pairs 245 must be increased as well. When the required degrees of turning is above 90 degrees, the number of cam walls 223 protruding from the cam component 220 reduces from two to one, the number of manipulating posts 249 on the central housing 240 reduces from two to one, and the number of cam barriers 245 decreases from two pairs to one pair. 180 degrees of turning is the maximum possible arrangement. With 180 degrees of turning, there will only be a single cam barrier protruding from the inner housing wall of the central housing 240.

Figure 6A:
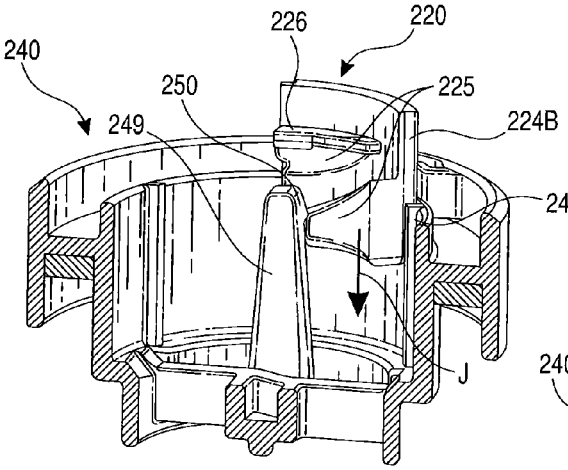
FIG. 6A is a cross section view of a central housing and cam component of the push-on twist-off bottle closure of the present invention during a locking operation.

FIG. 6A is a cross section view of a central housing and cam component of the push-on twist-off bottle closure of the present invention during a locking operation. During the locking operation, the cam groove structures 225 move downward in shown direction J relative to hammer-head protrusions 250 of the central housing 240. This downward motion continues until the manipulating post 249 temporarily bends away from the cam groove structures 225, allowing the hammer-head protrusion 250 to snap past the locking ridge 226, locking the cam component 220 in place vertically, and effectively locking the main seal 260 in its bulged state.

Figure 6B:
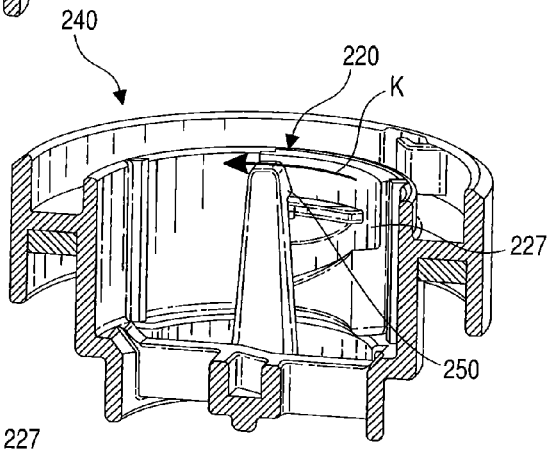
FIG. 6B is a cross section view of a central housing and cam component of the push-on twist-off bottle closure of the present invention during an initiation of an unlocking operation.

FIG. 6B is a cross section view of a central housing and cam component of the push-on twist-off bottle closure of the present invention during an initiation of an unlocking operation. During the unlocking operation, the cam groove structures are turned in a shown counter-clockwise direction K. This rotational motion causes the ridge gap 227 to move closer to the hammer-head protrusions 250. At the end of the turning motion in shown direction K, the ridge gap 227 is preferably directly under the hammer-head protrusion 250.

Figure 6C:
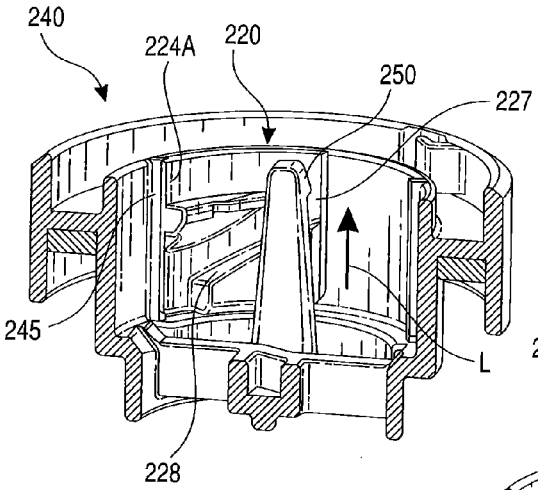
FIG. 6C is a cross section view of a central housing and cam component of the push-on twist-off bottle closure of the present invention at the beginning of an expansion of the bottle closure during an unlocking operation.

FIG. 6C is a cross section view of a central housing and cam component of the push-on twist-off bottle closure of the present invention at the beginning of an expansion of the bottle closure during an unlocking operation. During the turning motion, the cam component 220 is prevented from overturning by the interaction of the left cam wall edge 224A against the cam barrier 245 of the central housing 240. The cam component 220 automatically lifts upward in shown direction L due to the potential energy released into the system as the main seal 260 returns from its bulged state to its non-bulged state. The ridge gap 227 passes by the hammer-head protrusion 250.

Figure 6D:
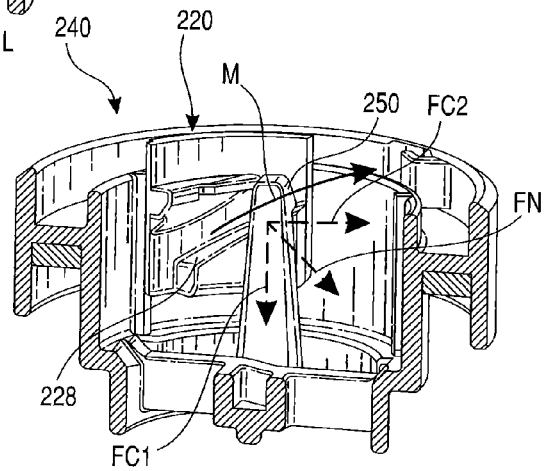
FIG. 6D is a cross section view of a central housing and cam component of the push-on twist-off bottle closure of the present invention at the end of an expansion of the bottle closure during an unlocking operation.

FIG. 6D is a cross section view of a central housing and cam component of the push-on twist-off bottle closure of the present invention at the end of an expansion of the bottle closure during an unlocking operation. The hammer-head protrusion 250 preferably engages a cam ramp 228 of the cam groove structures 225. The normal force between the hammer-head protrusions 250 and the cam ramp 228 is angled, as illustrated by shown force line FN. Both downward resistance, indicated by shown component force line FC1, and lateral acceleration, indicated by shown component force line FC2, are supplied to the upward moving cam component 220. The cam component 220 may thus automatically rotate in a clockwise helical direction as indicated by shown direction M. At the end of this motion, the system returns to the state shown in FIG. 6A. Overturning of the cam component 220 in shown direction M at the end of this automatic operation is prevented by the interaction of the right cam wall edge 224B against the cam barrier 245.

It should be obvious to someone practiced in the art that the embodiments of the cam groove structures 225 and the manipulating posts 249 could be altered so that their exhibited motions are essentially swapped. In an alternative embodiment, the cam groove structures 225 are a static feature of the central housing 240, and the manipulating posts 249 extend from the cam component 220. In another alternative embodiment, the cam groove structures 225 are a static feature of the central housing 240, and the manipulating posts 249 extend from the cap interface 210.

FIG. 7 is a cross sectional view of a cap interface of the push-on twist-off bottle closure of the present invention. The upside-down cup-shaped cap interface 210 is comprised of a thin outer cap wall 211, a closed circular surface 212, fastener clips 213, and a retaining ring groove 214. A retaining ring 215 is permanently attached to the retaining ring groove 214.

The cap interface 210 is defined by the thin cylindrical outer cap wall 211 with the closed circular surface 212 on its top end. The outer cap wall 211 is concentric and adjacent to the outer housing wall 241 of the central housing 240. The user pushes on the closed circular surface 212 during the locking operation, forcing the outer cap wall 211 to slide vertically downward relative to the central housing 240. During the unlocking operation, the user twists the outer cap wall 211, rotating the outer cap wall 211 relative to the central housing 240.

On the underside of the closed circular surface 212, four fastener clips 213 protrude vertically downward. These fastener clips 213 statically retain the cam component 220 to the underside of the closed circular surface 212 by grasping complimentary retaining grooves 222 cut into the upper retaining plate 221. It should be obvious to someone practiced in the art that the cam component 220 could be statically connected to the cap interface 210 by a variety of alternate means, including gluing, heat staking, ultrasonic welding, various snap fit connections, or by creating a single integrated part in a single injection mold.

In the primary embodiment, during the unlocking operation, before the bottle closure 200 begins to expand, one of the fastener clips 213 also acts as an obstruction that must be turned past the motion interrupting gate 244 of the central housing 240.

A retaining ring groove 214 is cut into the bottom of the thin outer cap wall 211 of the cap interface 210. A retaining ring 215, whose inner diameter is preferably smaller than the outer diameter of the outer cap wall 211, may be ultrasonically welded to the retaining ring groove 214. At the end of the unlocking operation, when the user wishes to access the contents of the bottle 100, he lifts the bottle closure 200 off of the bottle 100 via the cap interface 210. As the user pulls upward on the cap interface 210, the retaining ring 215 lifts the outer housing wall 241 upward, ensuring that all components of the bottle closure 200 lift off of the bottle 100 together.

Figure 8:
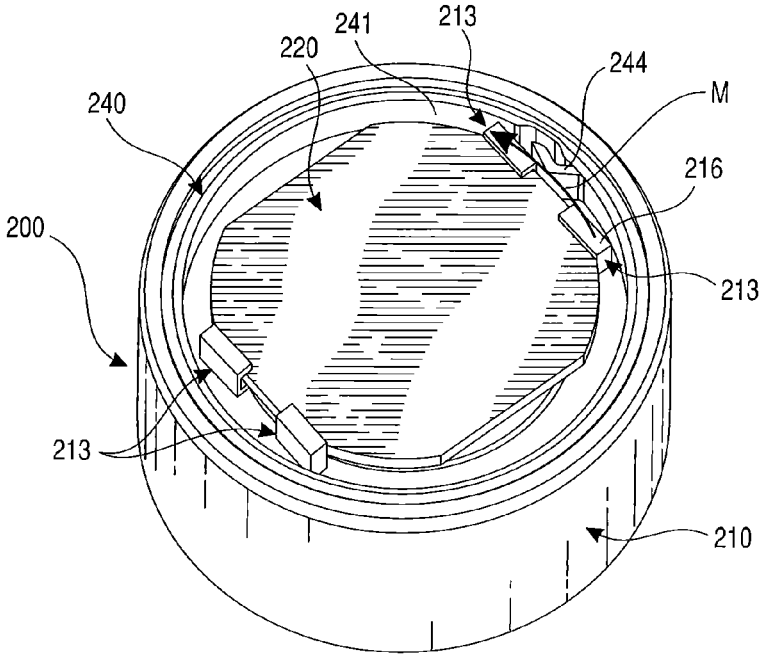
FIG. 8 shows from a top view a cam component connected to a cap interface looking inside the push-on twist-off bottle closure of the present invention.

FIG. 8 shows from a top view a cam component connected to a cap interface looking inside the push-on twist-off bottle closure of the present invention. One of the hook features 213 of the cap interface 210 that fastens the cam component 220 to the cap interface 210 may also double as an obstruction 216 to the turning motion during the unlocking operation. During the unlocking operation, as the cap interface 210 is turned by the user in a shown counter-clockwise direction M, the obstruction 216 pushes against the motion interrupting gate 244 at the point directly before the bottle closure 200 begins to expand. At this point, the user preferably adds turning strength to the cap interface 210 forcing the obstruction 216 to deform the motion interrupting gate 244 so that it becomes somewhat flush with the outer housing wall 241 of the central housing 240. The obstruction 216 moves past the motion interrupting gate 244, and its friction against the motion interrupting gate results in a "click" feeling or audible "click" noise, which serves as an indication to the user that their turning motion is completed. The bottle closure 200 begins to automatically expand in height.

Figure 9:
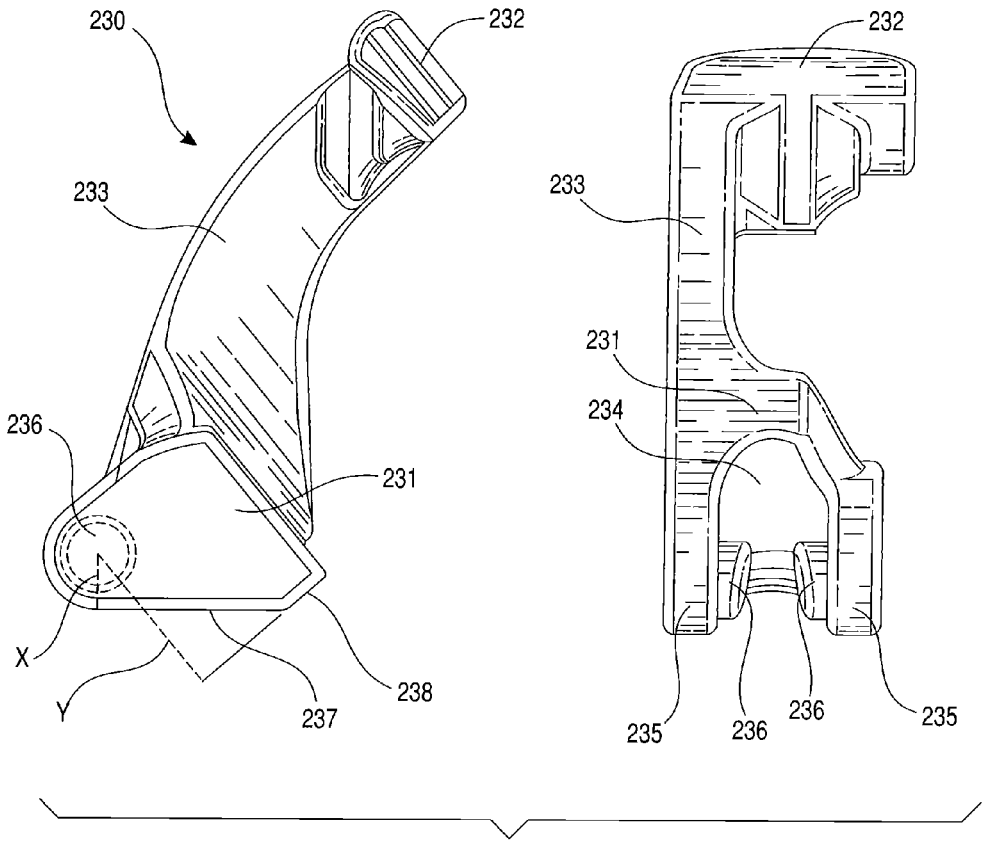
FIG. 9 shows side and back views of a lever of the push-on twist-off bottle closure of the present invention.

FIG. 9 shows side and back views of a lever of the push-on twist-off bottle closure of the present invention. This lever 230, together with its counterpart lever (an exact copy of lever 230 not shown in this FIG. 9), primarily acts to enable the opposing motions of the compressing platform 270 and the cap interface 210, so as the cap interface 210 is pushed downward, the compressing platform 270 moves upward, and vice versa. The lever 230 is comprised of a thin-walled arm 233, a lever head 232, a lever foot 231, a pivoting recess 234, pivoting foot members 235, circular nubs 236, long flat foot surfaces 237, and short flat foot surfaces 238.

The lever 230 consists of a thin-walled arm 233 with a lever head 232 protruding laterally at one end, and a lever foot 231 protruding laterally at the opposing end. The lever head 232 maintains loose contact with the underside of the upper retaining plate 221 of the cam component 220 in all of the locked and unlocked positions that may be taken by the bottle closure 200. The lever foot 231 maintains contact with the lever tracks 247 in all configurations of the bottle closure 200.

A pivoting recess 234 may be cut through the lever foot 231, forming two pivoting foot members 235. Two circular nubs 236 may extend inward from each of the pivoting foot members 235, corresponding in size and shape to bores in the post features of the compressing platform 270. The circular nubs 236 connect to and are able to rotate within the bores of the compressing platform. As the compressing platform 270 rises and falls, so do the circular nubs 236 rise and fall, and vice versa.

Each of the foot members 235 contains a long flat surface 237 that rests against the lever tracks 247 in the unsealed configuration. A smaller adjacent short flat surface 238 rests against the lever tracks 247 in the sealed configuration. The shown orthogonal distance X between the central axis of the nubs 236 and the surface of the long flat surface 237 is preferably shorter than the shown orthogonal distance Y between the central axis of the nubs 236 and the short flat surface 238. During the locking operation, when the cap interface 210 is pushed downward, and in turn pushes the lever head 232 downward, the lever foot 231 is forced to rotate, with the circular nubs 236 at the center of that rotation. Contact between the lever foot 231 and the lever tracks 247 transfers from the long flat surface 237 to the short flat surface 238. The distance between the circular nubs 236 and the lever tracks 247 increases from distance X to distance Y. This increase in distance allows the levers 230 to raise the compressing platform 270. In turn, when the unlocking operation is performed, the decrease in this distance, from distance Y to distance X, allows the compressing platform 270 to lower.

Figure 10:
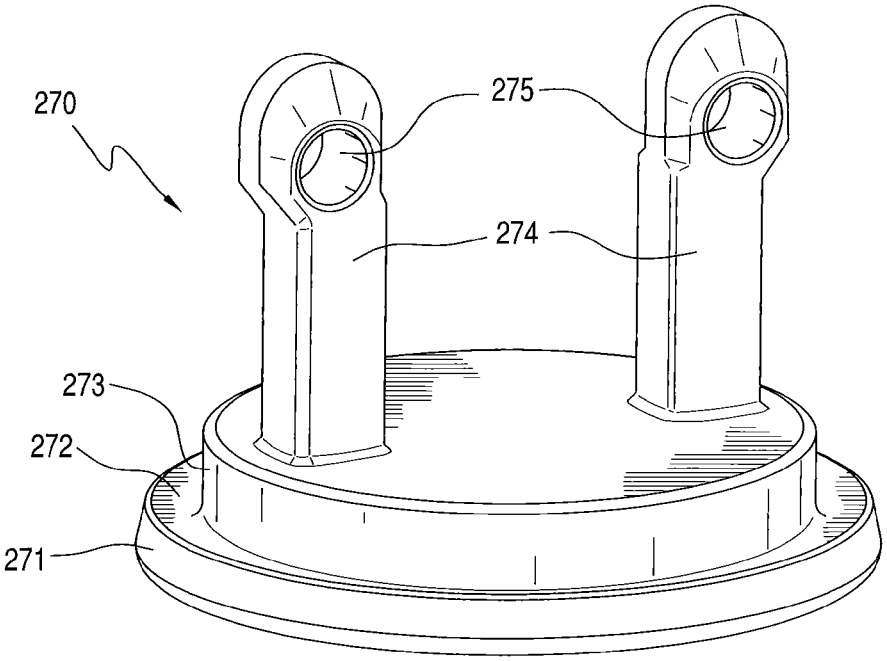
FIG. 10 is a perspective view of a compressing platform of the push-on twist-off bottle closure of the present invention.

FIG. 10 is a perspective view of a compressing platform of the push-on twist-off bottle closure of the present invention. The compressing platform 270 primarily acts to squeeze the main seal 260 vertically, forcing the main seal 260 into its bulged form. The compressing platform 270 is comprised of a solid circular disk 271, a lower seal seat floor 272, a lower seal seat wall 273, two radially symmetric pivot posts 274, and cylindrical bores 275.

The base of the compressing platform 270 is a solid circular disk 271. Two radially symmetric pivot posts 274 extend upward from the solid circular disk 271. These pivot posts 274 have primarily rectangular cross-sections and are dimensioned to slide into the rectangular slots 248 of the central housing 240. The pivot posts 274 and the rectangular slots 248 confine the compressing platform 270 to exhibit only upward and downward motions (and not any side to side or rotational motions). Preferably cutting through the top of these pivot posts 274, from one side to the other side of the pivot posts 274, are cylindrical bores 275 whose axes are parallel to each other and to the solid circular disk 271. The nubs 236 of the levers 230 attach to and rotate within the cylindrical bores 275. During the locking and unlocking operations, as the nubs 236 lift or lower, so does the compressing platform 270 lift or lower.

A lower seal seat floor 272 and lower seal seat wall 273 are defined by a cut around the circumference of the solid circular disk 271. The lower end of the main seal 260, as shown in FIG. 2, fits snuggly around the lower seal seat wall 273, and stays anchored to the lower seal seat wall 273 preferably by a tight fit around the lower seal seat wall 273. Alternatively, the main seal 260 could be glued to the lower seal seat wall 273 for extra support, or could be anchored to the lower seal seat wall 273 by any other viable means of attachment.

The bottom surface of the main seal 260 stays in contact with the lower seal seat floor 272. During the locking operation, as the compressing platform 270 rises, the lower seal seat floor 272 pushes upward on the bottom of the main seal 260, and the main seal 260 bulges, storing potential energy. During the unlocking operation, the main seal 260 shifts from its bulged state to its non-bulged state, and converts the potential energy into kinetic energy. The bottom of the main seal 260 pushes downward against the lower seal seat floor 272, moving the entire compressing platform 270 downward.

In an alternative embodiment, the amount of energy stored during the locking operation and released during the unlocking operation is supplemented by a spring. The spring is anchored in a central bore or on a central rod embodied by the compressing platform 270. In the unlocked state, the spring spans the distance from the solid circular disk 271 of the compressing platform 270 to the underside of the housing floor 246 of the central housing 240. During the locking operation, the spring compresses and stores potential energy. During the unlocking operation, the spring expands converting potential energy into kinetic energy.

Figure 11:
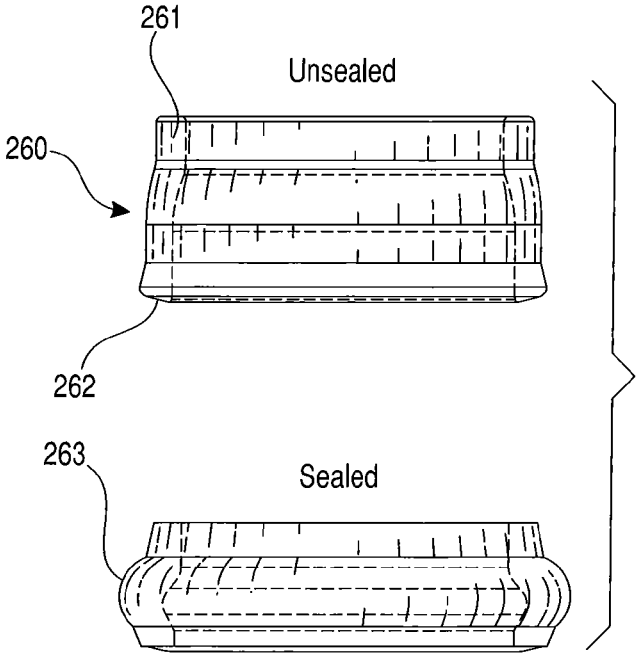
FIG. 11 shows a front view of a main seal of the push-on twist-off bottle closure in sealed and unsealed positions.

FIG. 11 shows a front view of a main seal of the push-on twist-off bottle closure in sealed and unsealed positions. A main seal 260 may be primarily cylindrically shaped and is preferably molded using a flexible, non-porous, food-safe material, such as a suitable rubber. The top end 261 has an inner diameter that is slightly smaller than the outer diameter of the housing floor 246 of the central housing 240. The flexible material of the top end 261 squeezes inward against the central housing 240, so that the main seal 260 stays anchored to the central housing 240, and so that no liquid may pass through the surfaces in contact between the main seal 260 and the central housing 240. The bottom end 262 has an inner diameter that is slightly smaller than the outer diameter of the lower seal seat wall 273 of the compressing platform 270. The flexible material at the bottom end 262 squeezes inward against the compressing platform 270, so that the main seal 260 stays anchored to the compressing platform 270, and so that no liquid may pass through the surfaces in contact between the main seal 260 and the compressing platform 270.

The bottom end 262 of the main seal 260 is slightly larger in diameter than the top end 261. When the main seal 260 is compressed vertically along its central axis, this difference in diameters forces the main seal 260 to bulge outward in a predictable manner, creating bulge 263. At the end of the locking operation, this bulge 263 presses up against the inner wall of the bottle 100 around its entire circumference, sealing the contents of the bottle 100 inside the bottle 100.

Having described and illustrated the principles of this application by reference to one or more preferred embodiments, it should be apparent that the preferred embodiment(s) may be modified in arraignments and detail without departing from the principles disclosed herein and that it is intended that the application be construed as including all such modifications and variations insofar as they come within the spirit and scope of the subject matter disclosed herein.

What is claimed is:

1. A closure system comprising:

a receptacle including an open-top wall structure defining a container for receiving material to be stored;

a closure disposable on the housing in a closed position relative to the receptacle;

a cap interface movably carried by the closure which is alternately actuated by a pushing movement by a user and a turning movement by a user;

a seal carried by the closure and shiftable between a compressed condition for sealingly engaging the wall structure when the closure is disposed in the closed position, and an uncompressed condition for disengaging from the wall structure; and a cam mechanism coupled to the cap interface and to the seal for effecting movement of the seal to its compressed condition in response to the pushing movement on the cap interface, and for effecting movement of the seal to its uncompressed position in response to the turning movement on the cap interface;

wherein the cap interface is comprised of a central housing, the central housing comprised of an outer housing wall, am inner housing wall, a washer seal seat, cam carrier, a housing floor, manipulating posts, manipulating protrusions, and a washer seal.

2. The closure system of claim 1, wherein the cap interface is primarily molded using plastic.

3. The closure s tem of claim 1, wherein the cap interface is slidably connected to the central housing.

4. The closure system of claim 1, wherein the cap interface further comprises a cam wall, cam groove structures, and a cam ramp.

5. The closure system of claim 1, wherein the seal is substantially cylindrically shaped.

6. The closure of claim 1, wherein the seal is molded using rubber.

7. A closure system comprising:

a receptacle including an open-top wall structure defining a container for receiving material to be stored;

a closure disposable on the housing in a closed position relative to the receptacle;

a cap interface movably carried by the closure which is alternatively actuated by a pushing movement by a user and a turning movement by a user;

a seal carried by the closure and shiftable between a compressed condition for sealingly engaging the wall structure when the closure is disposed in the closed position, and an uncompressed condition for disengaging from the wall structure; and a cam mechanism coupled to the cap interface and to the seal for effecting movement of the seal to its compressed condition in response to the pushing movement on the cap interface, and for effecting movement of the seal to its uncompressed position in response to the turning movement on the cap interface;

wherein the cam mechanism is comprised of a cam wall, and a lever pivotally connected to a compressing platform.

8. The closure system of claim 7, wherein the cam mechanism is further comprised of a left cam wall edge, a right cam wall edge, cam groove structures, a locking ridge, a ridge gap, and a camp ramp.

9. The closure system of claim 8, wherein the cam ramp has an angle between 5 and 85 degrees.

10. The closure system of claim 8, wherein the locking ridge is slidably connected to the central housing.

11. The closure system of claim 7, wherein the level further comprises a thin-walled arm, a lever head, a lever foot, a pivoting recess, pivoting foot members, circular nubs, long flat foot surfaces, and short flat foot surfaces.

12. The closure system of claim 11, wherein the lever head protrudes laterally at one end, and a lever foot protrudes laterally at the opposing end.

13. The closure system of claim 7, wherein the cam wall is slidably connected to the central housing of the cap interface.

14. The closure system of claim 7, wherein the compressing platform further comprises a substantially circular shaped disk, a lower seal seat floor in the substantially circular shaped disk, and a pivot post.

* * * * *